US006030090A

United States Patent [19]

Huang

[11] Patent Number: 6,030,090

[45] Date of Patent: Feb. 29, 2000

[54] COMBINATION SCREWDRIVER WITH ILLUMINATION

[76] Inventor: Sunny En-Liung Huang, 786 Via Monte Video St., Claremont, Calif. 91711

[21] Appl. No.: 09/124,042

[22] Filed: Jul. 29, 1998

[51] Int. Cl.[7] ..... F21V 33/00

[52] U.S. Cl. ..... 362/109; 362/119

[58] Field of Search ..... 362/109, 119, 362/120; 385/88, 147, 901

[56] References Cited

U.S. PATENT DOCUMENTS

| | | | |
|---|---|---|---|
| 3,919,541 | 11/1975 | Chao | 240/6.46 |
| 4,253,134 | 2/1981 | Barnaby | 362/119 |
| 4,302,797 | 11/1981 | Cooper | 362/119 |
| 4,480,295 | 10/1984 | Shuster | 362/206 |
| 4,768,137 | 8/1988 | Hwaw et al. | 362/120 |
| 5,628,556 | 5/1997 | Hrabar et al. | 362/119 |
| 5,882,103 | 3/1999 | Brantley et al. | 362/119 |

*Primary Examiner*—Cassandra Spyrou
*Assistant Examiner*—Mark A. Robinson
*Attorney, Agent, or Firm*—Bacon & Thomas, PLLC

[57] ABSTRACT

A combination screwdriver with illumination, comprising a handle part, a connector part and a tool part, on the handle part is a joining hole that may be directly or indirectly joined to the end of the connector part for fixing purpose, on the other end of the connector part is also a joining hole that may be joined to the tool part for fixing purpose, to compose a practical hand tool; characterized in that: the connector part is a hollow cylinder, at its rear end is a lighting set, at the front of the lighting set is a light guiding construction, so designed that when the connector part is joined to the tool part, the light source from the lighting set at its rear end will be projected through the light guiding construction to the front area of the tool part, to enable working convenience; furthermore, the connector part of the invention may also be applicable to a conventional electricity-powered screwdriver or conventional combination screwdrivers, so the product of the connector part can have its individuality with a wider and deeper range of applications, to enhance its economical efficiency, and avoid the consumers from repeated purchasing.

3 Claims, 5 Drawing Sheets

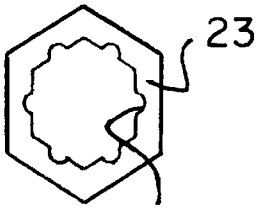
FIG. 3A
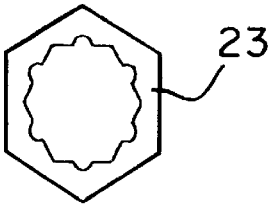
FIG. 3B
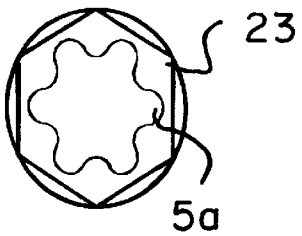
FIG. 3C
FIG. 3D
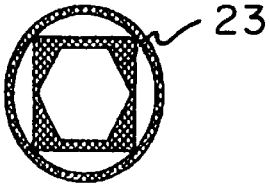
FIG. 3E
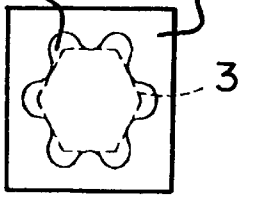
FIG. 3F
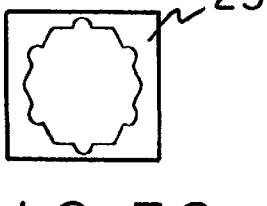
FIG. 3G
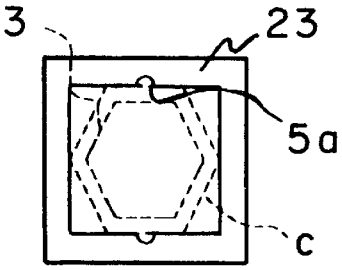
FIG. 3H
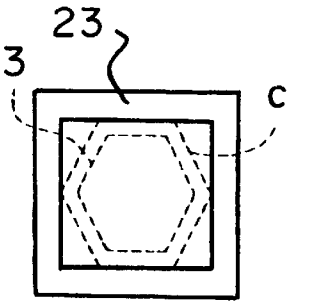
FIG. 3I

COMBINATION SCREWDRIVER WITH ILLUMINATION

BACKGROUND OF THE INVENTION

The invention relates to a combination screwdriver with illumination, particularly one with proper illumination at the front of a tool part (one of a range of screwdriver bits) to facilitate the user to work in a dark area; the connector part of the invention may be compatible to applications to a conventional electricity-powered or combination screwdrivers, to enhance the applicability and economical efficiency of the product.

Conventionally, a regular screwdriver, including an independent type or a combination type, does not involve a lighting device, as a result, the lack of lighting on the screw position will be inconvenient to the work, or even the operation can become impossible, it will be quite inconvenient to hold a screwdriver in one hand and a flashlight in the other hand of the user; therefore, to redress the above shortcomings and provide the consumers with a better and practical product, there comes another type of screwdriver involving a lighting device installed inside its handle, said lighting device works like a regular flashlight, with the lighting coming out of the front of the handle to achieve the purpose of producing a screwdriver with lighting, for the convenience of consumers. However, such a conventional construction involves a lighting device installed inside the handle, it will have the weakness that when the light is too far away from the end of the screwdriver, so the light will become dim, or the light will be obstructed by a connector or a cylinder; said device could not be applicable to an electricity-powered screwdriver or a conventional socket wrench; furthermore, said lighting device is installed inside a handle, so it is not applicable to a combination screwdriver with a different joining construction, causing some inconveniences and unnecessary waste.

In view of the above shortcomings in a conventional type of combination screwdriver construction, or even an electricity-powered screwdriver or socket wrench, the inventor has devoted in intensive research, based on many years of experience in R&D, and has finally come up with a brand-new type of combination screwdriver with illumination.

SUMMARY OF THE INVENTION

The primary objective of the present invention is to present a combination screwdriver with illumination, involving a lighting set installed in the connector part in a combination screwdriver, with a light source that can be projected to the front area of the tool part by means of a light guiding construction.

A secondary objective of the invention is to present a combination screwdriver with illumination, wherein a connector part containing a lighting set will be directly is or indirectly joined to a screwdriver handle or the joining hole (head) on an electrically driven screwdriver, a pneumatic screwdriver or a socket wrench, to enable mutual exchange, while its connector part can be manufactured as an individual product to enhance its economical efficiency.

A third Objective of the invention is to present a combination screwdriver with illumination, wherein its light guiding construction will allow light to be projected via the main unit of the connector part or the tool part, to the front area of the tool part.

To achieve the above objectives, the invention comprises a handle part, a connector part and a tool part, said tool part may be either a slotted-head, a Philips-head or a hexagonal screwdriver, on the handle part is a joining hole that can be directly or indirectly joined to the end of the connector part for fixing purpose, on the other end of the connector is also a joining hole that may be joined to the tool part for fixing purpose, to compose a practical hand tool; characterized in that: the connector part is a hollow cylinder, at its rear is installed a lighting set, and at the front of said lighting set is a light guiding construction, so that when the connector part is joined to the tool part, the lighting set may project light.via the light guiding construction to the front area of the tool part, to facilitate the user.

For further understanding of the configuration, construction and performance of the invention, preferred embodiments are described in details with drawings below;

BRIEF DESCRIPTION OF DRAWINGS

FIG. 3 shows the sectional views marked A-I of some representative joining holes in the connector part.

DETAILED DESCRIPTION OF PREFERRED EMBODIMENT

Figure 1:
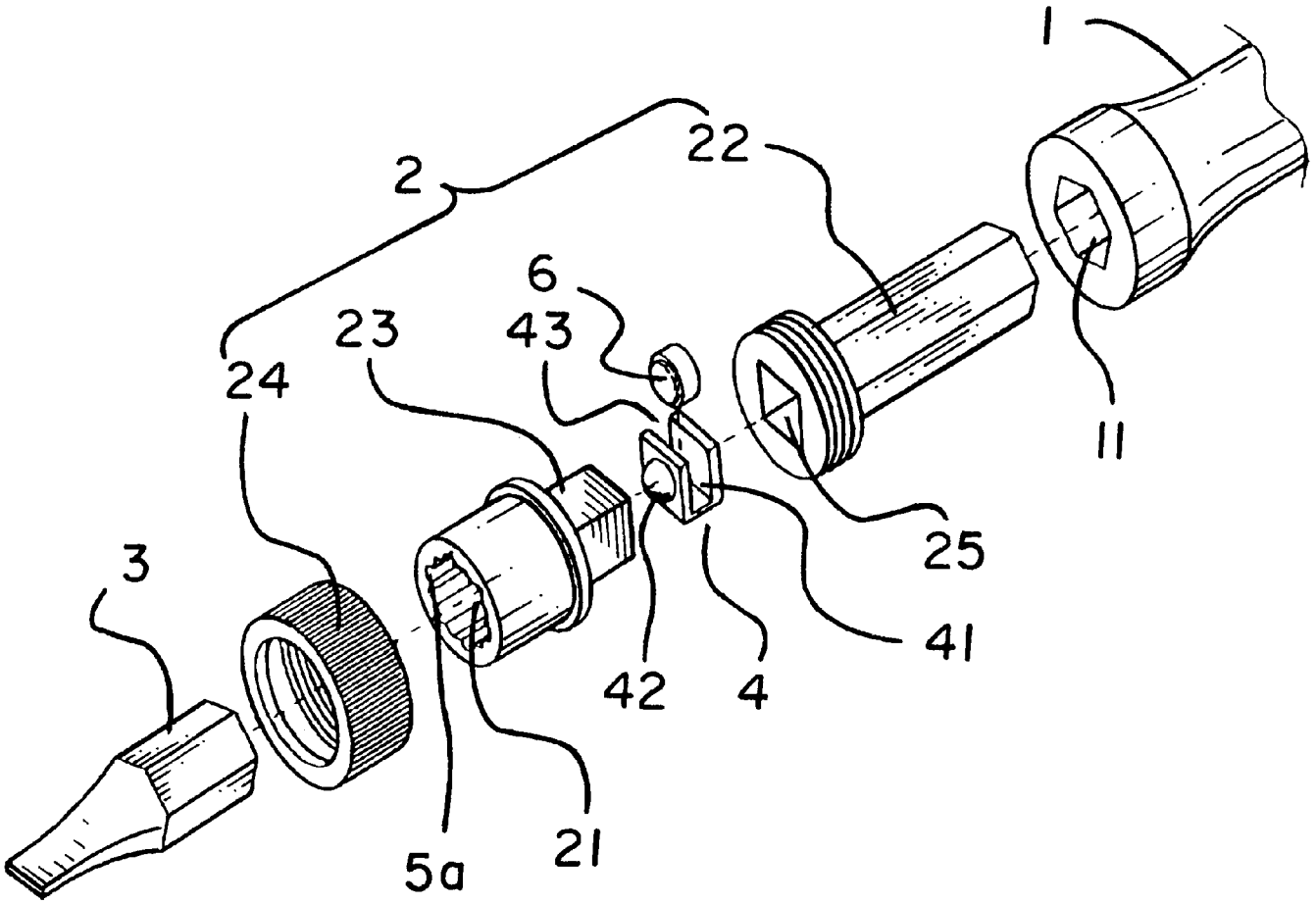
FIG. 1 is an exploded view of an embodiment of the invention.
Figure 2:
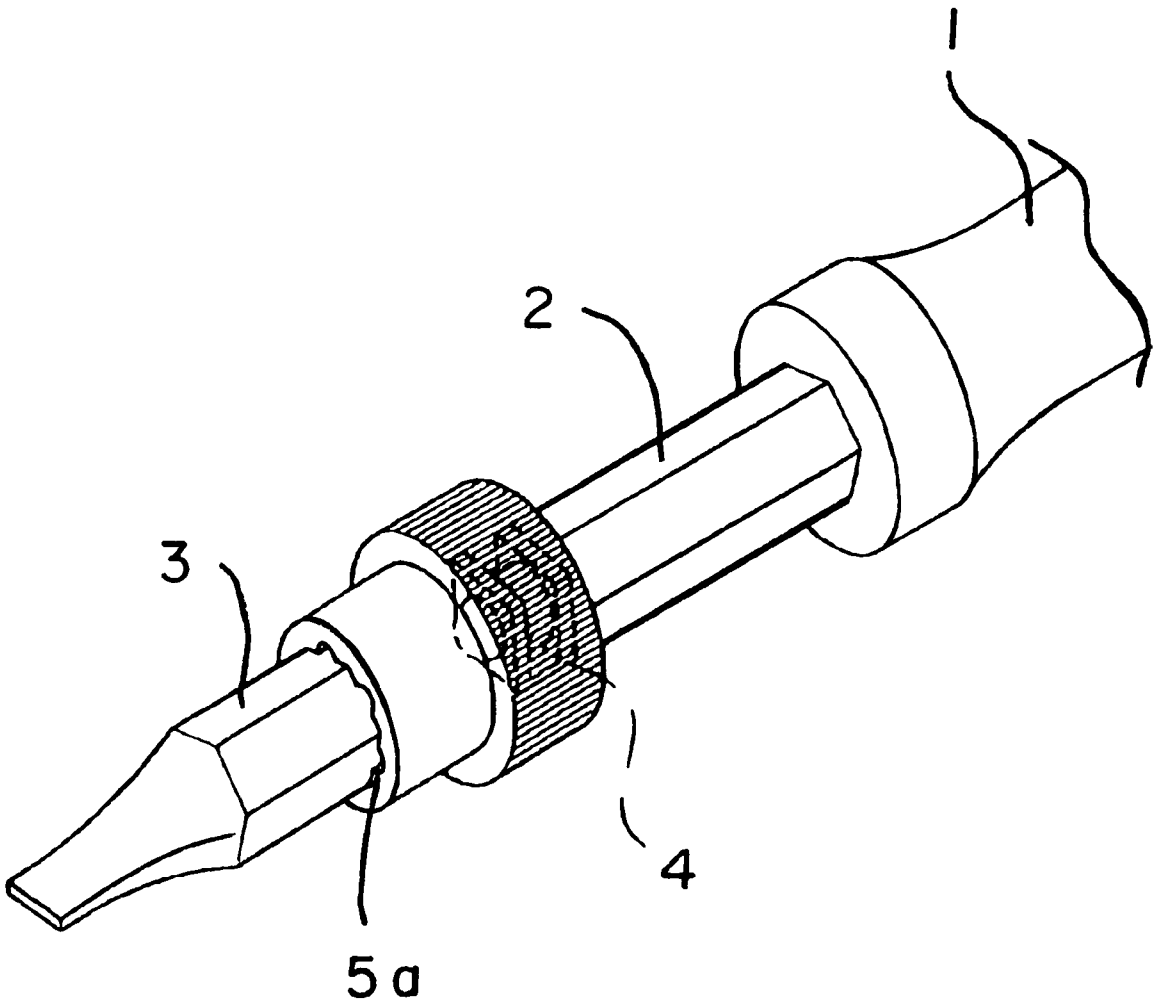
FIG. 2 is a perspective assembled view of FIG. 1.

Please refer to FIGS. 1 and 2, the present invention of "combination screwdriver with illumination" comprises a handle part 1, a connector part 2 and a tool part 3 (the handle part 1 mentioned herein may refer to the manual construction shown in the drawing, or other types or other electricity-powered, pneumatic or other constructions not shown in the drawings), on the handle part 1 is a joining hole 11 which can be directly or indirectly inserted by the end of the connector part 2 for fixing purpose, on the other end of the connector part 2 is also a joining hole 21 into which the tool part 3 can be fixed to compose a practical hand tool; characterized in that:

The connector part 2 is a hollow unit, to its rear end is a lighting set 4, on the front of the lighting set 4 is a light guide construction (groove line 5*a* or optical fiber 5*b*).

In the aforementioned embodiment, the tool part 3 may be a slot-head screwdriver, a Philips-head screwdriver or a hexagonal screwdriver, while the connector part 2 may be composed of a threaded rear part 22, a front part 23 and a locking nut 24, for threadedly engaging rear part 22 the exterior of the rear part 22 is so designed to match the joining hole 11 of the handle part 1 for joining and fixing purposes, on the front of said rear part 22 is an accommodating chamber 25 to accommodate the lighting set 4; the center of the front part 23 is a running-through joining hole 21 which can be joined to the tool part 3 for fixing purpose, on the wall of the joining hole 21 is one or more groove lines 5*a* that serves as a light-guiding construction, said front part 23 is then locked with the rear part 22 as one unit by the locking nut 24; the lighting set 4 is composed of a light holder 41 and no less than one lamp 42, on the lamp holder 41 is an opening 43 to accommodate with battery 6, said lighting set 4 will emit light when the battery is activated by the pressure from the tightened locking nut 24 on the connector part 2, or, the connector part 2 may be fitted with an electricity-powered or a pneumatic tool for application.

Figure 4C:
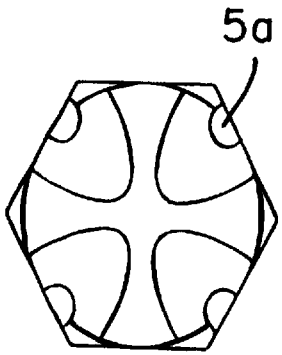
FIG. 4 shows the embodiment views marked A-C of the light guiding construction in the tool part.
Figure 4B:
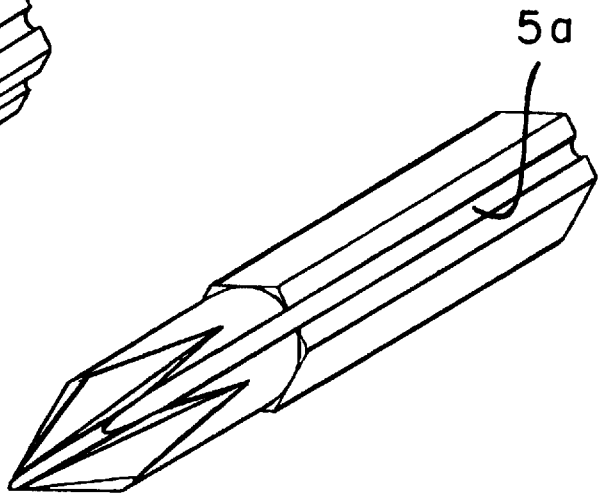
Figure 4A:
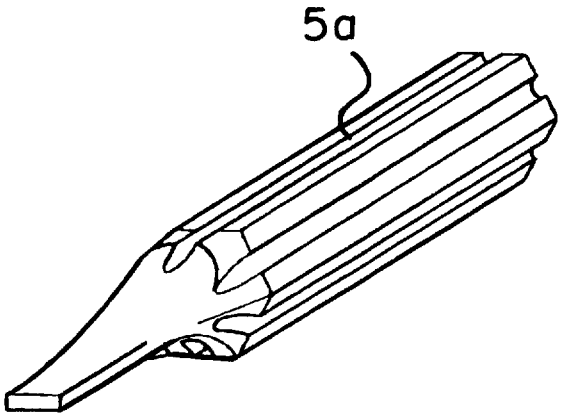

In the aforementioned connector part 2 construction, the shape of the joining hole 21 in the front part 23 may be one of the various patterns marked A to I in FIG. 3 or any other shapes for joining purposes; when it is joined with a tool part 3, it may involve a groove line 5*a* as mentioned in the previous paragraph as a light guiding construction, or it may involve spaces resulting from different shapes of the joining hole and the tool part, then the corner spaces c will serve as the light-guiding construction; or, on the outside wall of the tool part 3 may be one or more grooved lines 5*a* (as shown in A–C in FIG. 4), which serves as a light guiding construction 5 described herein. Such equivalent variations, however, shall be included in the subject claims.

With the aforementioned construction, the light source from the lighting set 4 in the connector part 2 will be projected through the light guiding construction in the grooved lines 5*a* on the inside wall of the joining hole 21 to the front of the tool part 3, to facilitate working convenience.

Figure 5:
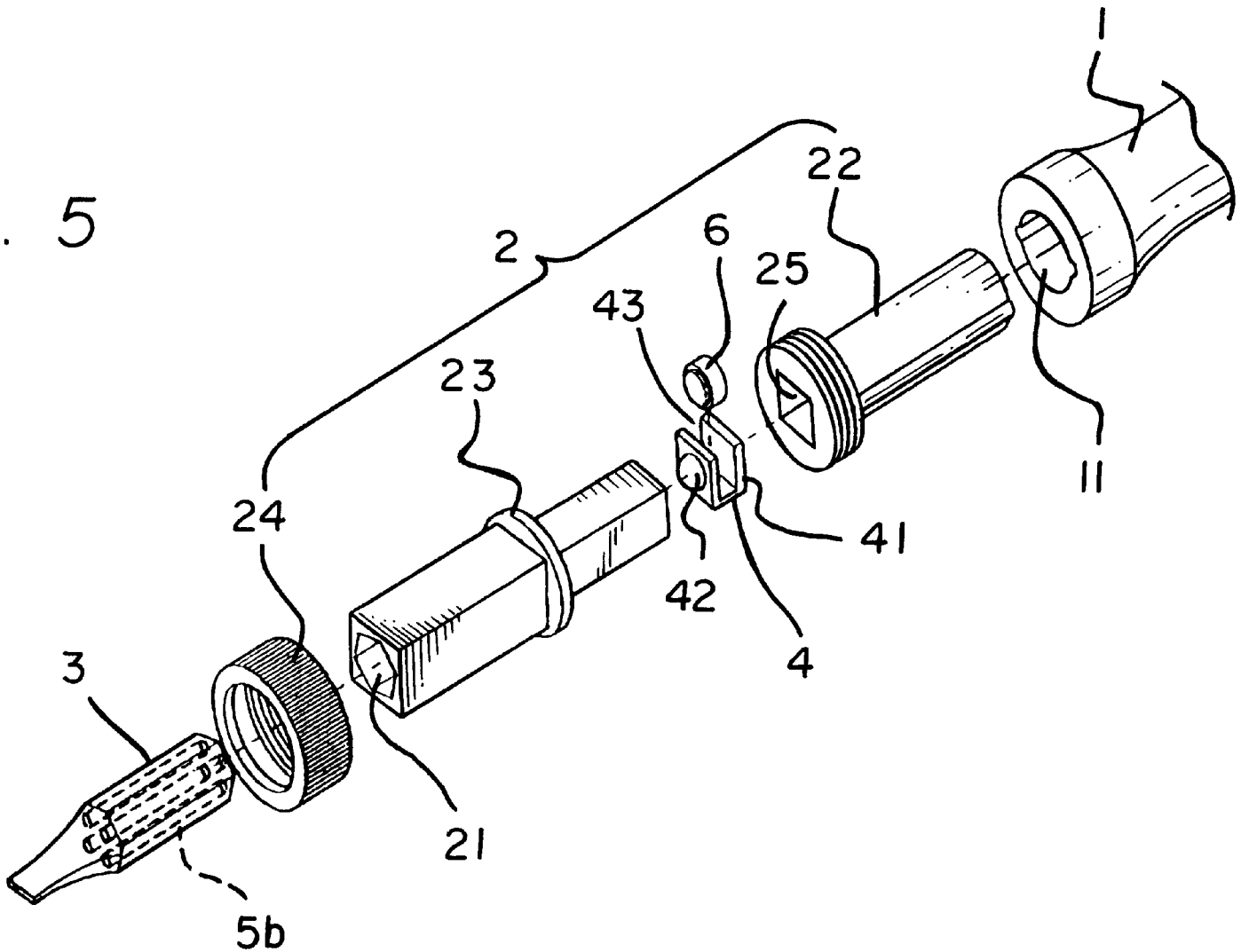
FIG. 5 is an exploded view of another embodiment of the invention.

Please refer to FIG. 5, in this embodiment, the joining hole 21 in the connector part 2 is to be inserted by the tool part 3, characterized in that: there is one or more optical fiber lines 5*b* on the tool part 3 that serve as a light guiding construction; said optical fiber lines 5*b* will serve to guide the light from the lighting set 4 in the connector part 2 to the front of the tool part 3, to achieve the objective of the invention.

Summing up, the invention of "combination screwdriver with illumination" will effectively redress the shortcomings of a conventional screwdrivers; furthermore, the subject matter of illumination is installed in the connector part, so it will be applicable to a conventional electricity-powered screwdriver, or such a connector construction will be applicable to various conventional types of combination screwdrivers, or such a connector part can be separately manufactured for sale, to increase its economical efficiency, and avoid repeated purchases for the consumers, therefore, it is an excellent invention.

I claim:

1. A combination screwdriver with illumination comprising:

a) a handle, a tool and a connector detachably securing the tool to the handle;

b) the connector including a front part having a joining hole within which a rear portion of the tool is received, a threaded rear part having a rear portion attached to the handle and a front chamber, a lighting set disposed within the front chamber, the lighting set including a lamp holder, a lamp and a battery, a locking nut threadedly engaged to the rear part for securing the front part and lighting set thereto, and a light guide for directing light from the lighting set to a front end of the tool part; and c) wherein the battery is activated to illuminate the lamp when tightening pressure is applied through the threaded engagement of the locking nut to the rear part.

2. The combination screwdriver with illumination of claim 1 wherein the light guide includes at least one groove along an inner wall of the joining hole in the front part.

3. The combination screwdriver with illumination of claim 1 wherein the light guide includes at least one optical fiber line on the tool.

* * * * *